US008069034B2

(12) United States Patent
Mäkinen et al.

(10) Patent No.: US 8,069,034 B2
(45) **Date of Patent: *Nov. 29, 2011**

(54) METHOD AND APPARATUS FOR ENCODING AN AUDIO SIGNAL USING MULTIPLE CODERS WITH PLURAL SELECTION MODELS

(75) Inventors: Jari Mäkinen, Tampere (FI); Ari Lakaniemi, Helsinki (FI); Pasi Ojala, Kauniainen (FI)

(73) Assignee: Nokia Corporation, Espoo (FI)

( * ) Notice: Subject to any disclaimer, the term of this patent is extended or adjusted under 35 U.S.C. 154(b) by 1763 days.

This patent is subject to a terminal disclaimer.

(21) Appl. No.: 11/126,380

(22) Filed: May 6, 2005

(65) Prior Publication Data

US 2005/0261892 A1 Nov. 24, 2005

(30) Foreign Application Priority Data

May 17, 2004 (WO) ..... PCT/IB2004/001579

(51) Int. Cl.

| | |
|---|---|
| ***G10L 19/00*** | (2006.01) |
| ***G10L 19/14*** | (2006.01) |
| ***G10L 11/06*** | (2006.01) |
| ***G10L 21/04*** | (2006.01) |

(52) U.S. Cl. ..... 704/201; 704/203; 704/208; 704/211; 704/214; 704/215; 704/217; 704/500; 704/503

(58) Field of Classification Search ..... 704/214, 704/201, 203, 208, 215, 217, 211, 500, 503
See application file for complete search history.

(56) References Cited

U.S. PATENT DOCUMENTS

| | | | | |
|---|---|---|---|---|
| 5,751,903 | A * | 5/1998 | Swaminathan et al. | 704/230 |
| 5,884,257 | A * | 3/1999 | Maekawa et al. | 704/248 |
| 6,134,518 | A * | 10/2000 | Cohen et al. | 704/201 |
| 6,167,375 | A * | 12/2000 | Miseki et al. | 704/229 |
| 6,173,265 | B1 * | 1/2001 | Takahashi | 704/262 |
| 6,477,502 | B1 * | 11/2002 | Ananthpadmanabhan et al. | 704/503 |
| 6,604,070 | B1 * | 8/2003 | Gao et al. | 704/222 |
| 6,640,209 | B1 | 10/2003 | Das | |
| 6,646,995 | B1 * | 11/2003 | Le Strat et al. | 370/252 |

(Continued)

FOREIGN PATENT DOCUMENTS

| | | |
|---|---|---|
| KR | 2004-0029318 | 4/2004 |
| WO | 03/042981 | 5/2003 |

OTHER PUBLICATIONS

Bessette, B.; Salami, R.; Lefebvre, R.; Jelinek, M.; Rotola-Pukkila, J.; Vainio, J.; Mikkola, H.; Jarvinen, K., "The adaptive multirate wideband speech codec (AMR-WB)," Speech and Audio Processing, IEEE Transactions on , vol. 10, No. 8, pp. 620-636, Nov. 2002.*

(Continued)

*Primary Examiner* — Paras Shah

(57) ABSTRACT

A method for supporting an encoding of an audio signal is shown, wherein at least a first and a second coder mode are available for encoding a section of the audio signal. The first coder mode enables a coding based on two different coding models. A selection of a coding model is enabled by a selection rule which is based on signal characteristics which have been determined for a certain analysis window. In order to avoid a misclassification of a section after a switch to the first coder mode, it is proposed that the selection rule is activated only when sufficient sections for the analysis window have been received. The invention relates equally to a module in which this method is implemented, to a device and a system comprising such a module and to a software program product including a software code for realizing the proposed method.

23 Claims, 2 Drawing Sheets

U.S. PATENT DOCUMENTS

| | | | | |
|---|---|---|---|---|
| 6,658,383 | B2 * | 12/2003 | Koishida et al. | 704/229 |
| 6,785,645 | B2 * | 8/2004 | Khalil et al. | 704/216 |
| 7,047,185 | B1 * | 5/2006 | Younes et al. | 704/201 |
| 7,605,722 | B2 * | 10/2009 | Beack et al. | 341/50 |
| 2002/0188442 | A1 * | 12/2002 | Gass et al. | 704/208 |
| 2003/0009325 | A1 * | 1/2003 | Kirchherr et al. | 704/211 |
| 2003/0093264 | A1 | 5/2003 | Miyasaka et al. | |
| 2006/0173675 | A1 * | 8/2006 | Ojanpera | 704/203 |

OTHER PUBLICATIONS

"A Wideband Speech and Audio Codec at 16/24/32 Kbit/s Using Hybrid ACELP/TCX Techniques" by B. Bessette et al, Speech Coding Proceedings, 1999 IEEE Workshop on Porvoo, Finland, Jun. 20-23, 1999, Piscataway, NJ, IEEE, US, Jun. 20, 1999, pp. 7-9.

3GPP TS 26.190 V5.1.0 (Dec. 2001), 3rd Generation Partnership Project; Technical Specification Group Services and System Aspects; Speech Codec speech processing functions; AMR Wideband speech codec; Transcoding functions (Release 5).

"Bridging the Gap Between Speech and Audio Coding", AMR-WB+—The codec for mobile audio, S. Bruhn: 'Online!, dated May 10, 2004, Retrieved from the Internet May 5, 2005: URL:http://www.s3.kth.se/radio/COURSES/S3_SEMINAR_2E1380_2004/presentations/EricssonAudio-040506.pdf>.

* cited by examiner

METHOD AND APPARATUS FOR ENCODING AN AUDIO SIGNAL USING MULTIPLE CODERS WITH PLURAL SELECTION MODELS

FIELD OF THE INVENTION

The invention relates to a method for supporting an encoding of an audio signal, wherein at least a first coder mode and a second coder mode are available for encoding a specific section of the audio signal. At least the first coder mode enables a coding of a specific section of the audio signal based on at least two different coding models. In the first coder mode a selection of a respective coding model for encoding a specific section of an audio signal is enabled by at least one selection rule which is based on an analysis of signal characteristics in an analysis window which covers at least one section of the audio signal preceding the specific section. The invention relates equally to a corresponding module, to a corresponding electronic device, to a corresponding system and to a corresponding software program product.

BACKGROUND OF THE INVENTION

It is known to encode audio signals for enabling an efficient transmission and/or storage of audio signals.

An audio signal can be a speech signal or another type of audio signal, like music, and for different types of audio signals different coding models might be appropriate.

A widely used technique for coding speech signals is the Algebraic Code-Excited Linear Prediction (ACELP) coding. ACELP models the human speech production system, and it is very well suited for coding the periodicity of a speech signal. As a result, a high speech quality can be achieved with very low bit rates. Adaptive Multi-Rate Wideband (AMR-WB), for example, is a speech codec which is based on the ACELP technology. AMR-WB has been described for instance in the technical specification 3GPP TS 26.190: "Speech Codec speech processing functions; AMR Wideband speech codec; Transcoding functions", V5.1.0 (2001-12). Speech codecs which are based on the human speech production system, however, perform usually rather badly for other types of audio signals, like music.

A widely used technique for coding other audio signals than speech is transform coding (TCX). The superiority of transform coding for audio signal is based on perceptual masking and frequency domain coding. The quality of the resulting audio signal can be further improved by selecting a suitable coding frame length for the transform coding. But while transform coding techniques result in a high quality for audio signals other than speech, their performance is not good for periodic speech signals. Therefore, the quality of transform coded speech is usually rather low, especially with long TCX frame lengths.

The extended AMR-WB (AMR-WB+) codec encodes a stereo audio signal as a high bitrate mono signal and provides some side information for a stereo extension. The AMR-WB+ codec utilizes both ACELP coding and TCX models to encode the core mono signal in a frequency band of 0 Hz to 6400 Hz. For the TCX model, a coding frame length of 20 ms, 40 ms or 80 ms is utilized.

Since an ACELP model can degrade the audio quality and transform coding performs usually poorly for speech, especially when long coding frames are employed, the respective best coding model has to be selected depending on the properties of the signal which is to be coded. The selection of the coding model that is actually to be employed can be carried out in various ways.

In systems requiring low complexity techniques, like mobile multimedia services (MMS), usually music/speech classification algorithms are exploited for selecting the optimal coding model. These algorithms classify the entire source signal either as music or as speech based on an analysis of the energy and the frequency properties of the audio signal.

If an audio signal consists only of speech or only of music, it will be satisfactory to use the same coding model for the entire signal based on such a music/speech classification. In many other cases, however, the audio signal that is to be encoded is a mixed type of audio signal. For example, speech may be present at the same time as music and/or be temporally alternating with music in the audio signal.

In these cases, a classification of entire source signals into music or speech category is a too limited approach. The overall audio quality can then only be maximized by temporally switching between the coding models when coding the audio signal. That is, the ACELP model is partly used as well for coding a source signal classified as an audio signal other than speech, while the TCX model is partly used as well for a source signal classified as a speech signal.

The extended AMR-WB (AMR-WB+) codec is designed as well for coding such mixed types of audio signals with mixed coding models on a frame-by-frame basis.

The selection of coding models in AMR-WB+ can be carried out in several ways.

In the most complex approach, the signal is first encoded with all possible combinations of ACELP and TCX models. Next, the signal is synthesized again for each combination. The best excitation is then selected based on the quality of the synthesized speech signals. The quality of the synthesized speech resulting with a specific combination can be measured for example by determining its signal-to-noise ratio (SNR). This analysis-by-synthesis type of approach will provide good results. In some applications, however, it is not practicable, because of its very high complexity. Such applications include, for example, mobile applications. The complexity results largely from the ACELP coding, which is the most complex part of an encoder.

In systems like MMS, for example, the full closed-loop analysis-by-synthesis approach is far too complex to perform. In an MMS encoder, therefore, a low complexity open-loop method is employed for determining whether an ACELP coding model or a TCX model is selected for encoding a particular frame.

AMR-WB+ offers two different low-complexity open-loop approaches for selecting the respective coding model for each frame. Both open-loop approaches evaluate source signal characteristics and encoding parameters for selecting a respective coding model.

In the first open-loop approach, an audio signal is first split up within each frame into several frequency bands, and the relation between the energy in the lower frequency bands and the energy in the higher frequency bands is analyzed, as well as the energy level variations in those bands. The audio content in each frame of the audio signal is then classified as a music-like content or a speech-like content based on both of the performed measurements or on different combinations of these measurements using different analysis windows and decision threshold values.

In the second open-loop approach, which is also referred to as model classification refinement, the coding model selection is based on an evaluation of the periodicity and the stationary properties of the audio content in a respective frame of the audio signal. Periodicity and stationary properties are evaluated more specifically by determining correlation, Long Term Prediction (LTP) parameters and spectral distance measurements.

The AMR-WB+ codec allows in addition switching during the coding of an audio stream between AMR-WB modes, which employ exclusively an ACELP coding model, and extension modes, which employ either an ACELP coding model or a TCX model, provided that the sampling frequency does not change. The sampling frequency can be for example 16 kHz.

The extension modes output a higher bit rate than the AMR-WB modes. A switch from an extension mode to an AMR-WB mode can thus be of advantage when transmission conditions in the network connecting the encoding end and the decoding end require a changing from a higher bit-rate mode to a lower bit-rate mode to reduce congestion in the network. A change from a higher bit-rate mode to a lower bit-rate mode might also be required for incorporating new low-end receivers in a Mobile Broadcast/Multicast Service (MBMS).

A switch from an AMR-WB mode to an extension mode, on the other hand, can be of advantage when a change in the transmission conditions in the network allows a change from a lower bit-rate mode to a higher bit-rate mode. Using a higher bit-rate mode enables a better audio quality.

Since the core codec use the same sampling rate of 6.4 kHz for the AMR-WB modes and the AMR-WB+ extension modes and employs at least partially similar coding techniques, a change from an extension mode to an AMR-WB mode, or vice versa, at this frequency band can be handled smoothly. As the core-band coding process is slightly different for an AMR-WB mode and an extension mode, care has to be taken, however, that all required state variables and buffers are stored and copied from one algorithm to the other when switching between the modes.

Further, it has to be taken into account that a coding model selection is only required in the extension modes. In the enabled open-loop classification approaches, relatively long analysis windows and data buffers are exploited. The encoding model selection exploits statistical analysis with analysis windows having a length of up to 320 ms, which corresponds to 16 audio signal frames of 20 ms. Since a corresponding information does not have to be buffered in the AMR-WB mode, it cannot simply be copied to the extended mode algorithms. After switching from AMR-WB to AMR-WB+, the data buffers of classification algorithms, for instance those used for a statistical analysis, have thus no valid information or they are reset.

During the first 320 ms after a switch, the coding model selection algorithm may thus not be fully adapted or updated for the current audio signal. A selection, which is based on non-valid buffer data results in a distorted coding model decision. For example, an ACELP coding model may be weighted heavily in the selection, even though the audio signal requires a coding based on a TCX model in order to maintain the audio quality.

Thus, the encoding model selection is not optimal, since the low complexity coding model selection performs badly after a switch from an AMR-WB mode to an extension mode.

SUMMARY OF THE INVENTION

It is an object of the invention to improve the selection of a coding model after a switching from a first coding mode to a second coding mode.

A method for supporting an encoding of an audio signal is proposed, wherein at least a first coder mode and a second coder mode are available for encoding a specific section of the audio signal. Further, at least the first coder mode enables a coding of a specific section of the audio signal based on at least two different coding models. In the first coder mode a selection of a respective coding model for encoding a specific section of an audio signal is enabled by at least one selection rule which is based on signal characteristics which have been determined at least partly from an analysis window which covers at least one section of the audio signal preceding the specific section. It is proposed that the method comprises after a switch from the second coder mode to the first coder mode activating the at least one selection rule in response to having received at least as many sections of the audio signal as are covered by the analysis window.

The first coder mode and the second coder mode can be for example, though not exclusively, an extension mode and an AMR-WB mode of an AMR-WB+ codec, respectively. The coding models available for the first coder mode can then be for example an ACELP coding model and a TCX model.

Moreover, a module for supporting an encoding of an audio signal is proposed. The module comprises a first coder mode portion adapted to encode a specific section of an audio signal in a first coder mode and a second coder mode portion adapted to encode a respective section of an audio signal in a second coder mode. The module further comprises switching means for switching between the first coder mode portion and the second coder mode portion. The coder mode portion includes an encoding portion which is adapted to encode a respective section of the audio signal based on at least two different coding models. The first coder mode portion further comprises a selection portion adapted to apply at least one selection rule for selecting a respective coding model, which is to be used by the encoding portion for encoding a specific section of an audio signal. The at least one selection rule is based on signal characteristics which have been determined at least partly from an analysis window covering at least one section of an audio signal preceding the specific section. The selection portion is adapted to activate the at least one selection rule after a switch by the switching means from the second coder mode portion to the first coder mode portion in response to having received at least as many sections of the audio signal as are covered by the analysis window.

This module can be for instance an encoder or a part of an encoder.

Moreover, an electronic device is proposed, which comprises such a module.

Moreover, an audio coding system is proposed which comprises such a module and in addition a decoder for decoding audio signals which have been encoded by such a module.

Finally, a software program product is proposed, in which a software code for supporting an encoding of an audio signal is stored on a non-transitory computer readable medium. At least a first coder mode and a second coder mode are available for encoding a respective section of the audio signal. At least the first coder mode enables a coding of a respective section of the audio signal based on at least two different coding models. In the first coder mode a selection of a respective coding model for encoding a specific section of an audio signal is enabled by at least one selection rule which is based on signal characteristics which have been determined from an analysis window which covers at least one section of the audio signal preceding the specific section. When running in a processing component of an encoder, the software code activates the at least one selection rule after a switch from the second coder mode to the first coder mode in response to having received at least as many sections of the audio signal as are covered by the analysis window.

The invention proceeds from the consideration that problems with invalid buffer contents which are used as the basis for a selection of a coding model can be avoided, if such a selection is only activated after the buffer contents have been updated at least to an extent required by the respective type of selection. It is therefore proposed that when a selection rule uses signal characteristics which have been determined using an analysis window over a plurality of sections of the audio signal, the selection rule is only applied when all sections required by the analysis window have been received. It is to be understood that the activation may be part of the selection rule itself.

It is an advantage of the invention that it enables an improved selection of the coding model after a switch of the coder mode. It allows more specifically to prevent a misclassification of sections of an audio signal, and thus to prevent the selection of an inappropriate coding model.

For the time after a switching in which some selection rules have not been activated, advantageously an additional selection rule is provided which does not use information on sections of the audio signal preceding the current section. This further rule can be applied immediately after a switching and at least as long until other selection rules have been activated.

The at least one selection rule which is based on signal characteristics which have been determined in an analysis window may comprise a single selection rule or a plurality of selection rules. In the latter case, the associated analysis windows may have different lengths. As a result, the plurality of selection rules may be activated one after the other.

The section of an audio signal can be in particular a frame of an audio signal, for instance an audio signal frame of 20 ms.

The signal characteristics which are evaluated by the at least one selection rule may be based entirely or only partly on an analysis window. It is to be understood that also the signal characteristics employed by a single selection rule may be based on different analysis windows.

BRIEF DESCRIPTION OF THE FIGURES

Other objects and features of the present invention will become apparent from the following detailed description considered in conjunction with the accompanying drawings.

DETAILED DESCRIPTION OF THE INVENTION

Figure 1:
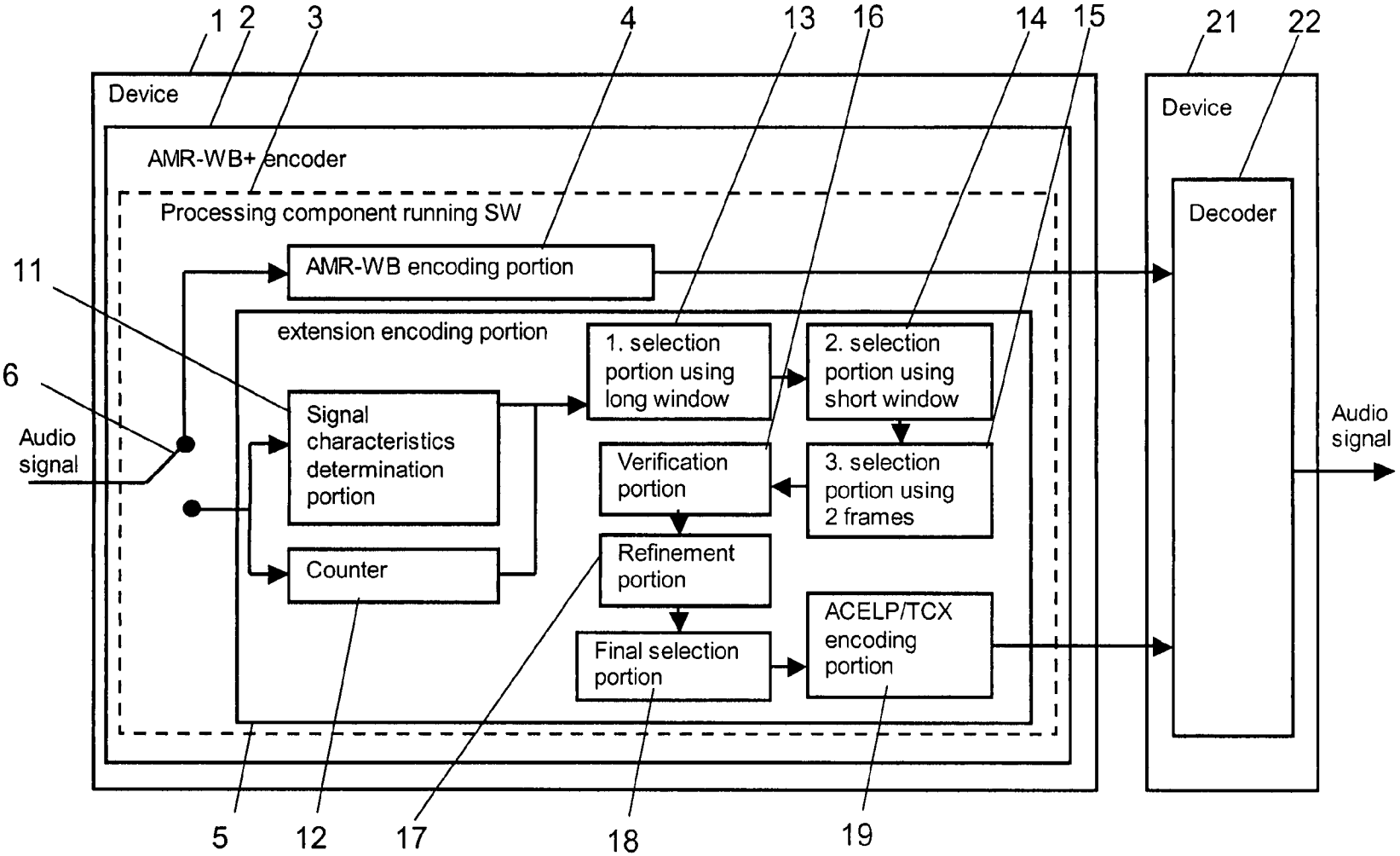
FIG. 1 is a schematic diagram of an audio coding system according to an embodiment of the invention.

FIG. 1 is a schematic diagram of an audio coding system according to an embodiment of the invention, which allows a soft activation of selection algorithms used for selecting an optimal coding model.

The system comprises a first device 1 including an AMR-WB+ encoder 2 and a second device 21 including an AMR-WB+ decoder 22. The first device 1 can be for instance an MMS server, while the second device 21 can be for instance a mobile phone or some other mobile device.

The AMR-WB+ encoder 2 comprises an AMR-WB encoding portion 4 which is adapted to perform a pure ACELP coding, and an extension encoding portion 5, which is adapted to perform a encoding based either on an ACELP coding model or on a TCX model. The extension encoding portion 5 thus constitutes the first coder mode portion and the AMR-WB encoding portion 4 the second coder mode portion of the invention.

The AMR-WB+ encoder 2 further comprises a switch 6 for forwarding audio signal frames either to the AMR-WB encoding portion 4 or to the extension encoding portion 5.

The extension encoding portion 5 comprises a signal characteristics determination portion 11 and a counter 12. The terminal of the switch 6 which is associated to the extension encoding portion 5 is linked to an input of both portions 11, 12. The output of the signal characteristics determination portion 11 and the output of the counter 12 are linked within the extension encoding portion 5 via a first selection portion 13, a second selection portion 14, a third selection portion 15, a verification portion 16, a refinement portion 17 and a final selection portion 18 to an ACELP/TCX encoding portion 19.

It is to be understood that the presented portions 11 to 19 are designed for encoding a mono audio signal, which may have been generated from a stereo audio signal. Additional stereo information may be generated in additional stereo extension portions not shown. It is moreover to be noted that the encoder 2 comprises further portions not shown. It is also to be understood that the presented portions 12 to 19 do not have to be separate portions, but can equally be interweaved among each others or with other portions.

The AMR-WB encoding portion 4, the extension encoding portion 5 and the switch 6 can be realized in particular by software code stored on a software program product wherein the software code may be run in a processing component 3 of the encoder 2, which is indicated by dashed lines.

The processing in the extension encoding portion 5 will now be described in more detail with reference to the flow chart of FIG. 2.

The encoder 2 receives an audio signal, which has been provided to the first device 1. At first, the switch 6 provides the audio signal to the AMR-WB encoding portion 4 for achieving a low output bit-rate, for example because there is not sufficient capacity in the network connecting the first device 1 and the second device 21. Later, however, the conditions in the network change and allow a higher bit-rate. The audio signal is therefore now forwarded by the switch 6 to the extension encoding portion 5.

In case of such a switch, a value StatClassCount of the counter 12 is reset to 15 when the first audio signal frame is received. In the following the counter 12 decrements its value StatClassCount by one, each time a further audio signal frame is input to the extension encoding portion 5.

Moreover, the signal characteristics determination portion 11 determines for each input audio signal frame various energy related signal characteristics by means of AMR-WB Voice Activity Detector (VAD) filter banks.

For each input audio signal frame of 20 ms, the filter banks produce the signal energy E(n) in each of twelve non-uniform frequency bands covering a frequency range from 0 Hz to 6400 Hz. The energy level E(n) of each frequency band n is then divided by the width of this frequency band in Hz, in order to produce a normalized energy level $E_N(n)$ for each frequency band.

Next, the respective standard deviation of the normalized energy levels $E_N(n)$ is calculated for each of the twelve frequency bands using on the one hand a short window $std_{short}(n)$ and on the other hand a long window $std_{long}(n)$. The short window has a length of four audio signal frames, and the long window has a length of sixteen audio signal frames. That is, for each frequency band, the energy level from the current frame and the energy level from the preceding 4 and 16 frames, respectively, are used to derive the two standard deviation values. The normalized energy levels of the preceding frames are retrieved from buffers, in which also the normalized energy levels of the current audio signal frame are stored for further use.

The standard deviations are only determined, however, if a voice activity indicator VAD indicates active speech for the current frame. This will make the algorithm react faster especially after long speech pauses.

Now, the determined standard deviations are averaged over the twelve frequency bands for both long and short window, to create two average standard deviation values $stda_{short}$, and $stda_{long}$ as a first and a second signal characteristic for the current audio signal frame.

For the current audio signal frame, moreover a relation between the energy in the lower frequency bands and the energy in the higher frequency bands is calculated. To this end, the signal characteristics determination portion 11 sums the energies E(n) of the lower frequency bands n=1 to 7 to obtain an energy level LevL. The energy level LevL is normalized by dividing it by the total width of these lower frequency bands in Hz. Moreover, the signal characteristics determination portion 11 sums the energies E(n) of the higher frequency bands n=8 to 11 to obtain an energy level LevH. The energy level LevH is equally normalized by dividing it by the total width of the higher frequency bands in Hz. The lowest frequency band 0 is not used in these calculations, because it usually contains so much energy that it will distort the calculations and make the contributions from the other frequency bands too small. Next, the signal characteristics determination portion 11 defines the relation LPH=LevL/LevH. In addition, a moving average LPHa is calculated using the LPH values which have been determined for the current audio signal frame and for the three previous audio signal frames.

Now, a final value LPHaF of the energy relation is calculated for the current frame by summing the current LPHa value and the previous seven LPHa values. In this summing, the latest values of LPHa are weighted slightly higher than the older values of LPHa. The previous seven values of LPHa are equally retrieved from buffers, in which also the value of LPHa for the current frame is stored for further use. The value LPHaF constitutes the third signal characteristic.

The signal characteristics determination portion 11 calculates in addition an energy average level of the filter banks AVL for the current audio signal frame. For calculating the value AVL, an estimated level of the background noise is subtracted from the energy E(n) in each of the twelve frequency bands. The results are then multiplied with the highest frequency in Hz of the corresponding frequency band and summed. The multiplication allows balancing the influence of the high frequency bands, which contain relatively less energy than the lower frequency bands. The value AVL constitutes a fourth third signal characteristic Finally, the signal characteristics determination portion 11 calculates for the current frame the total energy $TotE_0$ from all filter banks, reduced by an estimate of the background noise for each filter bank. The total energy $TotE_0$ is also stored in a buffer. The value $TotE_0$ constitutes a fifth signal characteristic.

The determined signal characteristics and the counter value StatClassCount are now provided to the first selection portion 13, which applies an algorithm according to the following pseudo-code for selecting the best coding model for the current frame:

```
if (StatClassCount == 0)
    SET TCX_MODE
if (stda_long < 0.4)
        SET TCX_MODE
else if (LPHaF > 280)
        SET TCX_MODE
else if ( stda_long >= 0.4)
        if ((5+(1/( stda_long -0.4))) > LPHaF)
            SET TCX_MODE
        else if ((-90* stda_long +120) < LPHaF)
            SET ACELP_MODE
        else
            SET UNCERTAIN_MODE
else
    headMode = UNCERTAIN_MODE
```

It can be seen that this algorithm exploits a signal characteristic $stda_{long}$, which is based on information on sixteen preceding audio signal frames. Therefore, it is checked first whether at least seventeen frames have already been received after the switch from AMR-WB. This is the case as soon as the counter 12 has a value StatClassCount of zero. Otherwise, an uncertain mode is associated immediately to the current frame. This ensures that the result is not falsified by invalid buffer contents resulting in incorrect values for signal characteristics $stda_{long}$ and LPHaF.

Information on the signal characteristics and the coding model selection performed so far is now forwarded by the first selection portion 13 to the second selection portion 14, which applies an algorithm according to the following pseudo-code for selecting the best coding model for the current frame:

```
if (ACELP_MODE or UNCERTAIN_MODE) and (AVL > 2000)
    SET TCX_MODE
if (StatClassCount < 5)
if (UNCERTAIN_MODE)
        if (stda_short < 0.2)
            SET TCX_MODE
        else if (stda_short >= 0.2)
            if ((2.5+(1/( stda_short -0.2))) > LPHaF)
                SET TCX_MODE
            else if ((-90* stda_short+140) < LPHaF)
                SET ACELP_MODE
            else
                SET UNCERTAIN_MODE
```

It can be seen that the second part of this algorithm exploits a signal characteristic $stda_{short}$, which is based on information on four preceding audio signal frames, and moreover a signal characteristic LPHaF, which is based on information on ten preceding audio signal frames. For this part of the algorithm it is therefore checked first whether at least eleven frames have already been received after the switch from AMR-WB. This is the case as soon as the counter has a value StatClassCount of '4'. This ensures that the result is not falsified by invalid buffer contents resulting in incorrect values for signal characteristics LPhaF and $stda_{short}$. On the whole, this algorithm allows a selection of a coding model already for the eleventh to sixteenth frame, and in addition even for the first ten frames in case the average energy level AVL exceeds a predetermined value. This part of the algorithm is not indicated in FIG. 2. The algorithm is equally applied for frames succeeding the sixteenth frame for refining the first selection by the first selection portion 13.

Information on the signal characteristics and the coding model selection performed so far is then forwarded by the second selection portion 14 to the third selection portion 15, which applies an algorithm according to the following pseudo-code for selecting the best coding model for the current frame, if the mode for this frame is still uncertain:

```
if (UNCERTAIN_MODE)
  if (StatClassCount<15)
    if ((TotE0/TotE-1)>25)
      SET ACELP_MODE
```

It can be seen that this pseudo-code exploits the relation between the total energy $TotE_0$ in the current audio signal frame and the total energy $TotE_{-1}$ in the preceding audio signal frame. It is therefore checked first, whether at least two frames have already been received after the switch from AMR-WB. This is the case as soon as the counter has a value StatClassCount of '14'.

It has to be noted that the employed counter threshold values are only examples and might be selected in many different ways. In the algorithm implemented in the second selection portion 14, for instance, the signal characteristic LPH could be evaluated instead of the signal characteristic LPHaF. In this case, it would be sufficient to check whether at least five frames have already been received, corresponding to StatClassCount<12.

Information on the signal characteristics and the coding model selection performed so far is then forwarded by the third selection portion 15 to the verification portion 16, which applies an algorithm according to the following pseudo-code:

```
if (TCX_MODE||UNCERTAIN_MODE))
  if (AVL>2000 and TotE0<60)
    SET ACELP_MODE
```

This algorithm allows selecting possibly the best coding model for the current frame, if the mode for this frame is still uncertain, and to verifying whether an already selected TCX mode is appropriate.

Also after the processing in the verification portion 16, the mode associated to the current audio signal frame may still be uncertain.

In a fast approach, now simply a predetermined coding model, that is either an ACELP coding model or a TCX coding model, is selected for the remaining UNCERTAIN mode frames.

Figure 2:
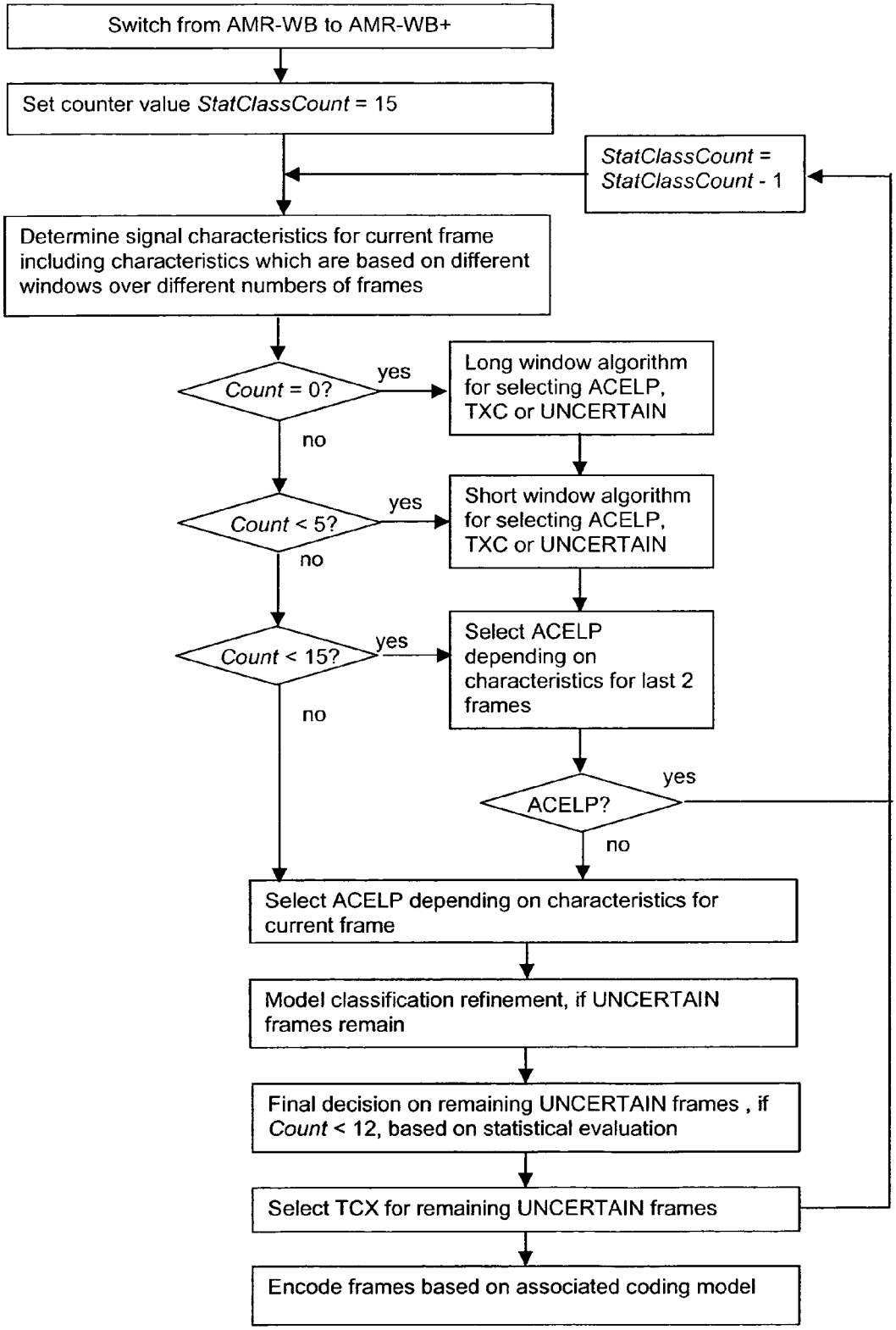
FIG. 2 is a flow chart illustrating an embodiment of the method according to the invention implemented in the system of FIG. 1.

In a more sophisticated approach, illustrated as well in FIG. 2, some further analysis is performed first.

To this end, information on the coding model selection performed so far is now forwarded by the verification portion 16 to the refinement portion 17. The refinement portion 17 applies a model classification refinement. As mentioned above, this is a coding model selection, which is based on the periodicity and the stationary properties of the audio signal. The periodicity is observed by using LTP parameters. The stationary properties are analyzed by using a normalized correlation and spectral distance measurements.

The analysis by portions 13, 14, 15, 16 and 17 determine based on audio signal characteristics whether the content of a respective frame can be assumed to be speech or other audio content, like music, and selected a corresponding coding model if such a classification is possible. Portions 13, 14, 15, 16 realize a first open loop approach evaluating energy related characteristics, while portion 17 realizes a second open loop approach evaluating periodicity and the stationary properties of the audio signal.

In case two different open loop approaches have been applied in vain to select a TCX model or an ACELP coding model, the optimal encoding model will be difficult to select in some cases by further existing open loop algorithms. In the present embodiment, therefore a simple counting-based classification is employed for the remaining unclear mode selections.

The final selection portion 18 selects a specific coding model for remaining UNCERTAIN mode frames based on a statistical evaluation of the coding models associated to the respective neighboring frames, if a voice activity indicator VADflag is set for the respective UNCERTAIN mode frame.

For the statistical evaluation, a current superframe, to which an UNCERTAIN mode frame belongs, and a previous superframe preceding this current superframe are considered. A superframe has a length of 80 ms and comprises four consecutive audio frames of 20 ms each. The final selection portion 18 counts by means of counters the number of frames in the current superframe and in the previous superframe for which the ACELP coding model has been selected by one of the preceding selection portions 12 to 17. Moreover, the final selection portion 18 counts the number of frames in the previous superframe for which a TCX model with a coding frame length of 40 ms or 80 ms has been selected by one of the preceding selection portions 12 to 17, for which moreover the voice activity indicator is set, and for which in addition the total energy exceeds a predetermined threshold value. The total energy can be calculated by dividing the audio signal into different frequency bands, by determining the signal level separately for all frequency bands, and by summing the resulting levels. The predetermined threshold value for the total energy in a frame may be set for instance to 60.

The assignment of coding models has to be completed for an entire current superframe, before the current superframe n can be encoded. The counting of frames to which an ACELP coding model has been assigned is thus not limited to frames preceding an UNCERTAIN mode frame. Unless the UNCERTAIN mode frame is the last frame in the current superframe, also the selected encoding models of upcoming frames are take into account.

The counting of frames can be summarized for instance by the following pseudo-code:

```
if ((prevMode(i) == TCX80 or prevMode(i) == TCX40) and
vadFlag_old(i)== 1 and
TotE_i > 60)
    TCXCount = TCXCount + 1
if (prevMode(i) == ACELP_MODE)
    ACELPCount = ACELPCount + 1
if (j != i)
    if (Mode(i) == ACELP_MODE)
        ACELPCount = ACELPCount + 1
```

In this pseudo-code, i indicates the number of a frame in a respective superframe, and has the values 1, 2, 3, 4, while j indicates the number of the current frame in the current superframe. prevMode(i) is the mode of the i:th frame of 20 ms in the previous superframe and Mode(i) is the mode of the i:th frame of 20 ms in the current superframe. TCX80 represents a selected TCX model using a coding frame of 80 ms and TCX40 represents a selected TCX model using a coding frame of 40 ms. $vadFlag_{old}(i)$ represents the voice activity indicator VAD for the i:th frame in the previous superframe. $TotE_i$ is the total energy in the i:th frame. The counter value TCXCount represents the number of selected long TCX frames in the previous superframe, and the counter value ACELPCount represents the number of ACELP frames in the previous and the current superframe.

A statistical evaluation is then performed as follows:

If the counted number of long TCX mode frames, with a coding frame length of 40 ms or 80 ms, in the previous superframe is larger than 3, a TCX model is equally selected for the UNCERTAIN mode frame.

Otherwise, if the counted number of ACELP mode frames in the current and the previous superframe is larger than 1, an ACELP model is selected for the UNCERTAIN mode frame.

In all other cases, a TCX model is selected for the UNCERTAIN mode frame.

The selection of the coding model Mode(j) for the j:th frame can be summarized for instance by the following pseudo-code:

```
if (TCXCount > 3)
    Mode(j) = TCX_MODE;
else if (ACELPCount > 1)
    Mode(j) = ACELP_MODE
else
    Mode(j) = TCX_MODE
```

The counting-based approach is only performed, if the counter value StatClassCount is smaller than 12. This means, that after switching from AMR-WB to an extension mode, the counting-based classification approach is not performed in the first four frames, which is for the first 4*20 ms.

If the counter value StatClassCount is equal to or larger than 12 and the encoding model is still classified as UNCERTAIN mode, the TCX model is selected.

If the voice activity indicator VADflag is not set, the flag thereby indicating a silent period, the selected mode is TCX by default and none of the mode selection algorithms has to be performed.

The portions 13, 14 and 15 thus constitute the at least one selection portion of the invention, while the portions 16, 17 and 18, and partly portion 14, constitute the at least one further selection portion of the invention.

The ACELP/TCX encoding portion 19 now encodes all frames of the audio signal based on the respectively selected coding model. The TCX model is based by way of example on a fast Fourier transform (FFT) using the selected coding frame length, and the ACELP coding model uses by way of example an LTP and fixed codebook parameters for a linear prediction coefficients (LPC) excitation.

The encoding portion 19 then provides the encoded frames for a transmission to the second device 21. In the second device 21, the decoder 22 decodes all received frames with the ACELP coding model or with the TCX coding model using an AMR-WB mode or an extension mode, as required. The decoded frames are provided for example for presentation to a user of the second device 21.

Summarized, the presented embodiment enables a soft activation of selection algorithms, in which the provided selection algorithms are activated in the order in which analysis buffers that are related to the selection rules are fully updated. While one or more selection algorithms are disabled, the selection is performed based on other selection algorithms, which do not rely on this buffer content.

It is to be noted that the described embodiment constitutes only one of a variety of possible embodiments of the invention.

The invention claimed is:

1. A method comprising:

after a switch from a second coder mode to a first coder mode of an encoder activating at least one selection rule in response to having received for said first coder mode at least as many sections of an audio signal as are covered by an analysis window, wherein at least said first coder mode and said second coder mode are available for encoding a specific section of said audio signal, wherein at least said first coder mode enables a coding of a specific section of said audio signal based on at least two different coding models, and wherein in said first coder mode a selection of a respective coding model for encoding said specific section of an audio signal is enabled by said at least one selection rule which is based on signal characteristics, which signal characteristics have at least partly been determined from said analysis window, which analysis window covers at least one section of said audio signal preceding said specific section; and encoding said audio signal using said first coder mode, resulting in an encoded audio signal.

2. A method according to claim 1, wherein in said first coder mode the selection of a respective coding model for encoding a specific section of an audio signal is further enabled by at least one further selection rule using no information on sections of said audio signal preceding said specific section, said at least one further selection rule being applied at least as long as the number of received sections is less than the number of sections covered by an analysis window, in which signal characteristics are determined for said at least one selection rule.

3. A method according to claim 1, wherein said at least one selection rule, which is based on signal characteristics that have been determined from an analysis window, comprises a first selection rule, which is based on signal characteristics that have been determined in a shorter analysis window, and a second selection rule, which is based on signal characteristics that have been determined in a longer analysis window, wherein said first selection rule is activated as soon as sufficient sections of said audio signal for said shorter analysis window have been received, and wherein said second selection rule is activated as soon as sufficient sections of said audio signal for said longer analysis window have been received.

4. A method according to claim 3, wherein a respective section of said audio signal corresponds to a respective audio signal frame having a length of 20 ms, wherein said shorter window covers an audio signal frame for which a coding model is to be selected and in addition four preceding audio signal frames, and wherein said longer window covers an audio signal frame for which a coding model is to be selected and in addition sixteen preceding audio signal frames.

5. A method according to claim 1, wherein said signal characteristics comprise a standard deviation of energy related values in a respective analysis window.

6. A method according to claim 1, wherein said first coder mode is an extension mode of an extended adaptive multi-rate wideband codec and enables a coding based on an algebraic code-excited linear prediction coding model and in addition a coding based on a transform coding model, and wherein said second coder mode is an adaptive multi-rate wideband mode of said extended adaptive multi-rate wideband codec and enables a coding based on an algebraic code-excited linear prediction coding model.

7. A method according to claim 1, wherein said section is a frame or a sub-frame of said audio signal.

8. An apparatus comprising a processor, said processor configured to encode a section of an audio signal in a first coder mode using one of at least two different coding models, said encoding resulting in an encoded audio signal;

said processor configured to encode a section of an audio signal in a second coder mode, said encoding resulting in an encoded audio signal;

said processor configured to switch between said first coder mode and said second coder mode; and said processor configured to apply at least one selection rule for selecting a specific coding model of said first coder mode, which coding model is to be used for encoding a specific section of an audio signal in said first coder mode, wherein said at least one selection rule is based on signal characteristics, which have at least partly been determined from an analysis window covering at least one section of an audio signal preceding said specific section, and wherein said processor is further configured to activate said at least one selection rule after a switch from said second coder mode to said first coder mode in response to having received for said first coder mode at least as many sections of said audio signal as are covered by said analysis window.

9. The apparatus according to claim 8, further comprising a counter adapted to count the number of sections of said audio signal, to which said first coder mode is to be applied, after a switch from said second coder mode to said first coder mode.

10. The apparatus according to claim 8, wherein said processor is further configured to apply at least one further selection rule for selecting a respective coding model, which coding model is to be used for encoding a specific section of an audio signal, wherein said at least one further selection rule uses no information on sections of said audio signal preceding said specific section, and wherein said processor is configured to apply said at least one further selection rule after a switch from said second coder mode to said first coder mode at least as long as the number of sections received for said first coder mode is less than the number of sections covered by an analysis window employed for said at least one selection rule which is based on an analysis of signal characteristics in an analysis window.

11. The apparatus according to claim 8, wherein said processor is configured to apply a first selection rule which is based on signal characteristics which have been determined in a shorter analysis window and to apply a second selection rule, which is based on signal characteristics that have been determined in a longer analysis window, wherein said processor is configured to activate said first selection rule as soon as sufficient sections of said audio signal for said shorter analysis window have been received for said first coder model after a switch from said second coder mode to said first coder mode, and wherein said processor is configured to activate said second selection rule as soon as sufficient sections of said audio signal for said longer analysis window have been received for said first coder model after a switch from said second coder mode to said first coder mode.

12. The apparatus according to claim 11, wherein a respective section of said audio signal corresponds to a respective audio signal frame having a length of 20 ms, wherein said shorter window covers an audio signal frame for which a coding model is to be selected and in addition four preceding audio signal frames, and wherein said longer window covers an audio signal frame for which a coding model is to be selected and in addition sixteen preceding audio signal frames.

13. The apparatus according to claim 8, wherein said processor is further configured to determine signal characteristics of said audio signal in a respective analysis window, said signal characteristics including a standard deviation of energy related values in a respective analysis window.

14. The apparatus according to claim 8, wherein said first coder mode is an extension mode of an extended adaptive multi-rate wideband codec, said processor being configured to encode sections of an audio signal in said first coder mode based on an algebraic code-excited linear prediction coding model and in addition based on a transform coding model, and wherein said second coder mode is an adaptive multi-rate wideband mode of said extended adaptive multi-rate wideband codec, said processor being configured to encode sections of an audio signal in said second coder mode based on an algebraic code-excited linear prediction coding model.

15. The apparatus according to claim 8, wherein said section is a frame or a sub-frame of said audio signal.

16. The apparatus according to claim 8, wherein said apparatus is one of an encoder, a part of an encoder and an electronic device comprising an encoder.

17. The apparatus according to claim 8, wherein said apparatus is a mobile device.

18. The apparatus according to claim 8, wherein said apparatus is a mobile phone.

19. An apparatus comprising:

means for encoding a respective section of an audio signal in a first coder mode based on at least two different coding models, said encoding resulting in an encoded audio signal;

means for encoding a respective section of an audio signal in a second coder mode, said encoding resulting in an encoded audio signal;

means for switching between said means for encoding a respective section of an audio signal in said first coder mode and said means for encoding a respective section of an audio signal in said second coder mode;

means for applying at least one selection rule for selecting a specific coding model, which coding model is to be used for encoding a specific section of an audio signal in said first coder mode, wherein said at least one selection rule is based on signal characteristics, which have at least partly been determined from an analysis window covering at least one section of an audio signal preceding said specific section; and means for activating said at least one selection rule after a switch from said means for encoding a respective section of an audio signal in said second coder mode to said means for encoding a respective section of an audio signal in said first coder mode in response to having received for said first coder mode at least as many sections of said audio signal as are covered by said analysis window.

20. An audio coding system comprising an apparatus according to claim 8 and a decoder for decoding audio signals, which have been encoded by said apparatus.

21. A non-transitory computer readable medium, in which a software code is stored, wherein at least a first coder mode and a second coder mode are available for encoding a respective section of said audio signal, wherein at least said first coder mode enables a coding of a respective section of said audio signal based on at least two different coding models, and wherein in said first coder mode a selection of a respective coding model for encoding a specific section of an audio signal is enabled by at least one selection rule, which is based on signal characteristics that have been determined from an analysis window, which covers at least one section of said audio signal preceding said specific section, said software code realizing the following when running in a processing component of an encoder:

activating said at least one selection rule after a switch from said second coder mode to said first coder mode in response to having received for said first coder mode at least as many sections of said audio signal as are covered by said analysis window; and encoding said audio signal using said first coder mode, resulting in an encoded audio signal.

22. The non-transitory computer readable medium according to claim 21, wherein in said first coder mode a selection of a respective coding model for encoding a specific section of an audio signal is further enabled by at least one further selection rule using no information on sections of said audio signal preceding said specific section, said at least one further selection rule being applied at least as long as the number of received sections is less than the number of sections covered by an analysis window, in which signal characteristics are determined for said at least one selection rule.

23. The non-transitory computer readable medium according to claim 21, wherein said at least one selection rule, which is based on signal characteristics that have been determined from an analysis window, comprises a first selection rule, which is based on signal characteristics that have been determined in a shorter analysis window, and a second selection rule, which is based on signal characteristics that have been determined in a longer analysis window, wherein said first selection rule is activated as soon as sufficient sections of said audio signal for said shorter analysis window have been received, and wherein said second selection rule is activated as soon as sufficient sections of said audio signal for said longer analysis window have been received.

* * * * *